US012710248B1

(12) United States Patent
Sorbonne et al.

(10) Patent No.: US 12,710,248 B1
(45) Date of Patent: Aug. 18, 2026

(54) APPARATUS FOR REMOTELY ADJUSTING SCOPE MAGNIFICATION

(71) Applicants: Arrius Lee Sorbonne, Layton, UT (US); Benjamin Latham Griffith, Salt Lake City, UT (US)

(72) Inventors: Arrius Lee Sorbonne, Layton, UT (US); Benjamin Latham Griffith, Salt Lake City, UT (US)

( * ) Notice: Subject to any disclaimer, the term of this patent is extended or adjusted under 35 U.S.C. 154(b) by 0 days.

(21) Appl. No.: 19/032,108

(22) Filed: Jan. 19, 2025

Related U.S. Application Data

(63) Continuation-in-part of application No. 18/527,095, filed on Dec. 1, 2023, now Pat. No. 12,546,986.

(60) Provisional application No. 63/623,136, filed on Jan. 19, 2024, provisional application No. 63/385,715, filed on Dec. 1, 2022.

(51) Int. Cl.
*F41G 1/38* (2006.01)

(52) U.S. Cl.
CPC ..... *F41G 1/38* (2013.01)

(58) Field of Classification Search
None
See application file for complete search history.

(56) References Cited

U.S. PATENT DOCUMENTS 2,913,826 A * 11/1959 Petty ..... F41G 1/38 42/122
3,486,432 A * 12/1969 Norwood ..... G03B 17/14 396/88
3,506,330 A * 4/1970 Allen ..... G02B 23/14 359/422
4,952,041 A 8/1990 Sandall
5,180,875 A 1/1993 Berry
5,276,554 A 1/1994 Nassivera
5,388,005 A * 2/1995 Wilson ..... G02B 7/102 359/422
5,528,847 A * 6/1996 Fisher ..... G02B 23/14 42/122
5,924,211 A * 7/1999 Wambold, Jr. ..... G02B 7/10 42/119
5,943,174 A * 8/1999 Bryant ..... H01J 29/98 359/809
6,226,880 B1 * 5/2001 Pitre ..... F41G 1/38 42/120
6,519,083 B2 * 2/2003 Heinrich ..... G02B 23/14 359/425
6,813,025 B2 * 11/2004 Edwards ..... F41G 1/38 359/399
7,246,461 B2 * 7/2007 Wooden ..... F41G 1/44 359/422
7,434,346 B2 * 10/2008 Scherpf ..... F41G 11/001 42/117
7,552,559 B2 * 6/2009 Day ..... G02B 23/145 42/122

(Continued)

*Primary Examiner* — Derrick R Morgan
(74) *Attorney, Agent, or Firm* — Lightfoot & Alford PLLC

(57) ABSTRACT

An assembly allows for remote control of magnification of a scope of a firearm, the assembly comprising a housing for an adjustable-magnification scope to be mounted thereto, a motor carried by the housing and coupled to a magnification adjuster ring of the scope for causing selective rotation thereof, and a battery carried by the housing and configured for providing electrical power to the motor and to accessories carried by the firearm. A switch actuated by a user controls operation of the motor.

7 Claims, 20 Drawing Sheets

(56) References Cited

U.S. PATENT DOCUMENTS

| | | | | |
|---|---|---|---|---|
| 9,459,440 | B2 * | 10/2016 | Zheng | G02B 23/145 |
| 9,494,787 | B1 * | 11/2016 | Bagwell | G02B 3/14 |
| 10,161,718 | B2 * | 12/2018 | Plumb | F41G 1/38 |
| 10,408,571 | B2 * | 9/2019 | Nobes | F41G 11/001 |
| 12,222,190 | B2 * | 2/2025 | Wen | F41G 11/003 |
| 2002/0122248 | A1 * | 9/2002 | Heinrich | G02B 23/14 359/425 |
| 2002/0184810 | A1 * | 12/2002 | Day | F41C 27/00 42/79 |
| 2005/0088729 | A1 * | 4/2005 | Edwards | F41G 1/38 359/359 |
| 2005/0252062 | A1 * | 11/2005 | Scrogin | F41G 3/065 42/114 |
| 2006/0096149 | A1 * | 5/2006 | Wooden | F41G 1/44 359/429 |
| 2009/0205239 | A1 * | 8/2009 | Smith, III | F41G 1/38 42/122 |
| 2012/0255213 | A1 * | 10/2012 | Panos | F41G 1/35 42/146 |
| 2017/0102208 | A1 * | 4/2017 | Plumb | F41G 1/38 |
| 2024/0167788 | A1 * | 5/2024 | Wen | F41G 1/35 |
| 2024/0345379 | A1 * | 10/2024 | Sevy | G02B 23/18 |

* cited by examiner

APPARATUS FOR REMOTELY ADJUSTING SCOPE MAGNIFICATION

CROSS-REFERENCE TO RELATED APPLICATIONS

This patent application is a continuation-in-part of U.S. Ser. No. 18/527,095, which was filed on 1 Dec. 2023 and claims the benefit of the filing date of U.S. 63/385,715, filed on 1 Dec. 2022, both titled "APPARATUS FOR REMOTELY ADJUSTING SCOPE MAGNIFICATION," and this patent application also claims the benefit of the filing date of U.S. 63/623,136, filed on 19 Jan. 2024 and titled "FIREARM-MOUNTED BATTERY BANK," the entire content of each being hereby expressly incorporated by reference.

BACKGROUND

Telescopic sights ("scopes") for firearms may have adjustable magnification, which is usually adjusted via a rotating ring near the eyepiece. A user typically rotates the ring by grasping the ring, though a lever or similar protruding component may be coupled to the ring to aid in manual adjustment. These methods of adjustment require the user to remove a hand from gripping the firearm to rotate the ring, which may lead to a missed shot during the adjustment motions.

DETAILED DESCRIPTION

Figure 1:
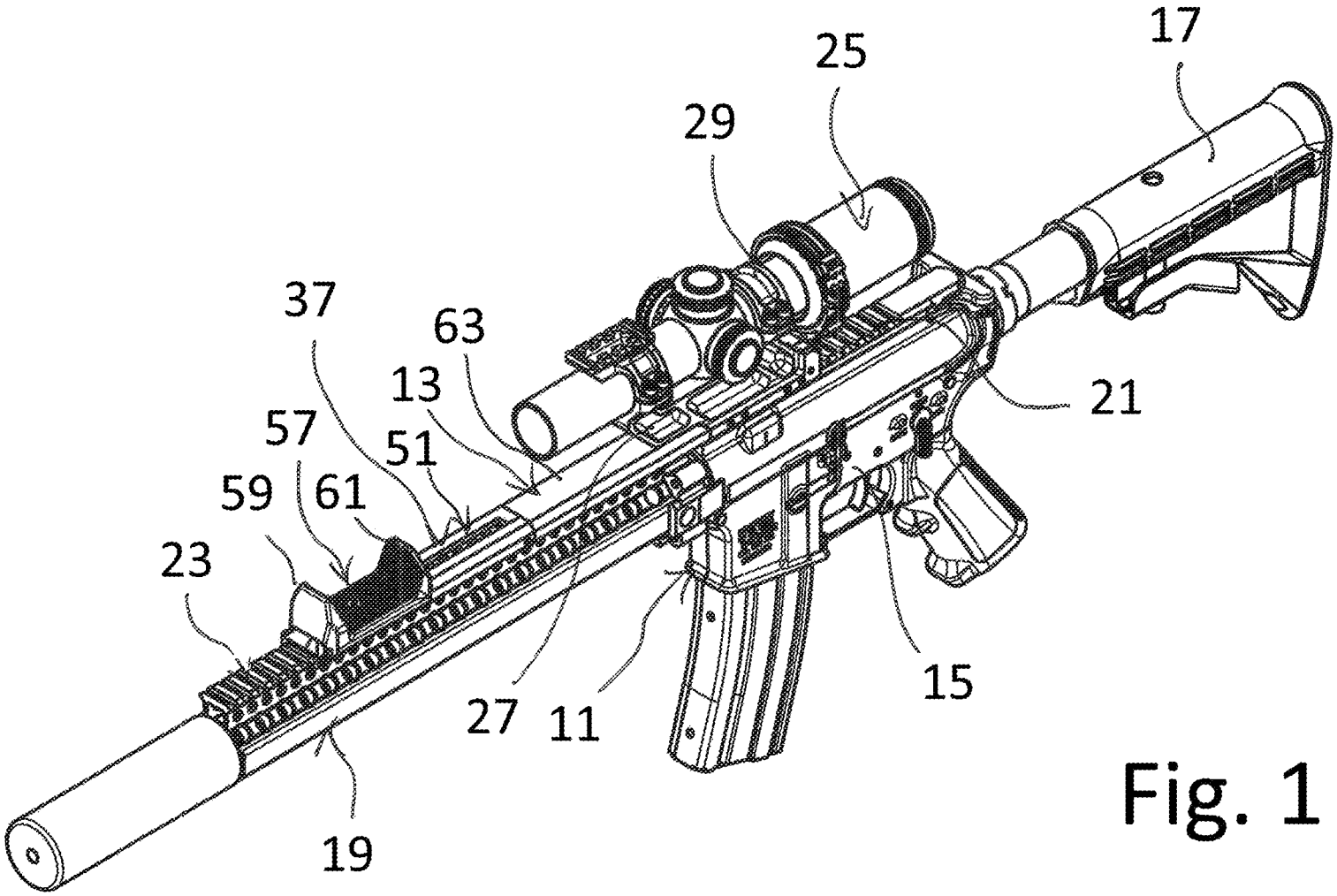
FIG. 1 is an oblique view of a firearm with an embodiment of an apparatus according to this disclosure for remotely adjusting scope magnification.
Figure 2:
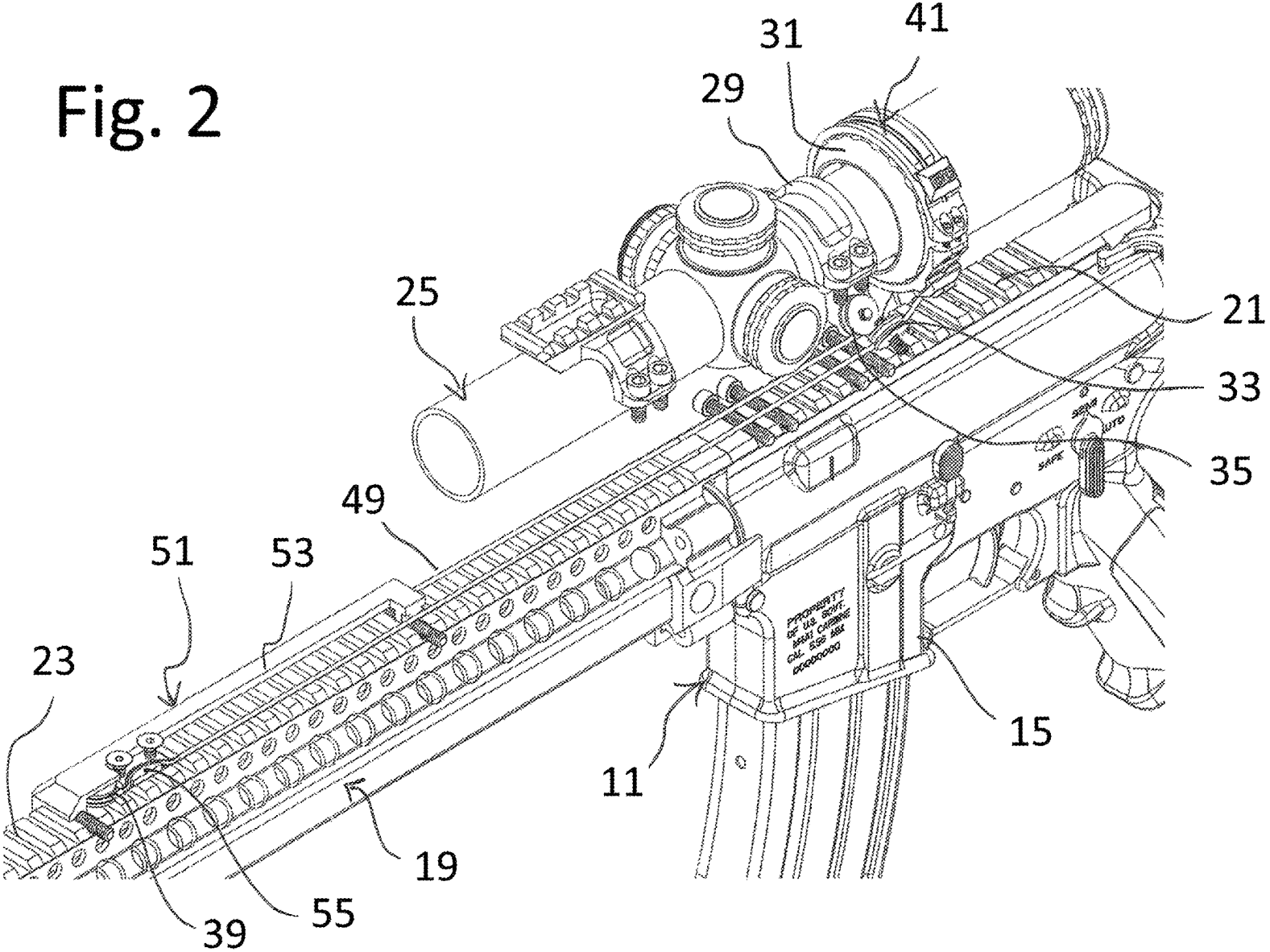
FIG. 2 is an oblique view of a portion of the firearm of FIG. 1 with components removed for ease of viewing.
Figure 3:
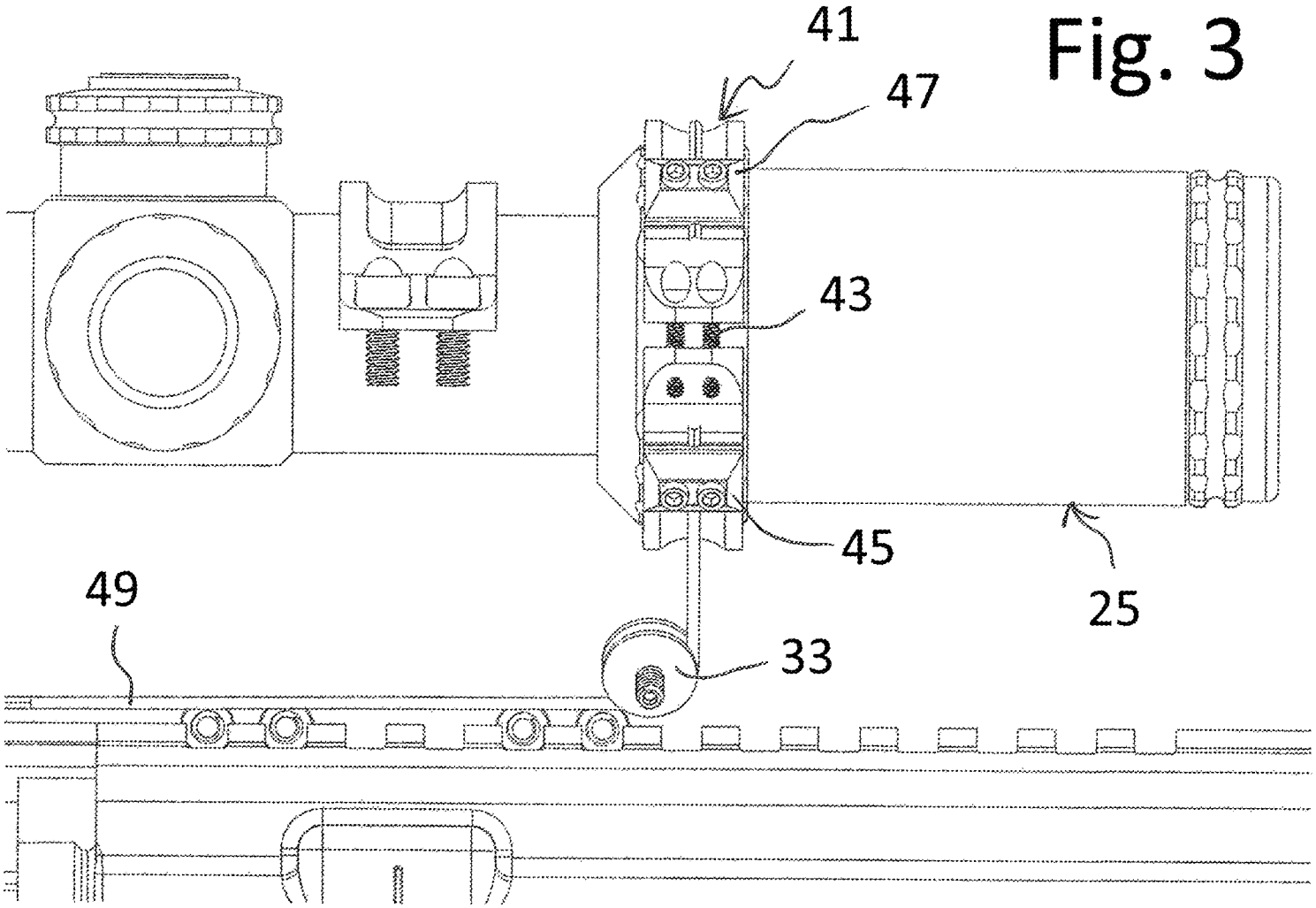
FIG. 3 is a side detail view of portions of the apparatus of FIG. 1.
Figure 4:
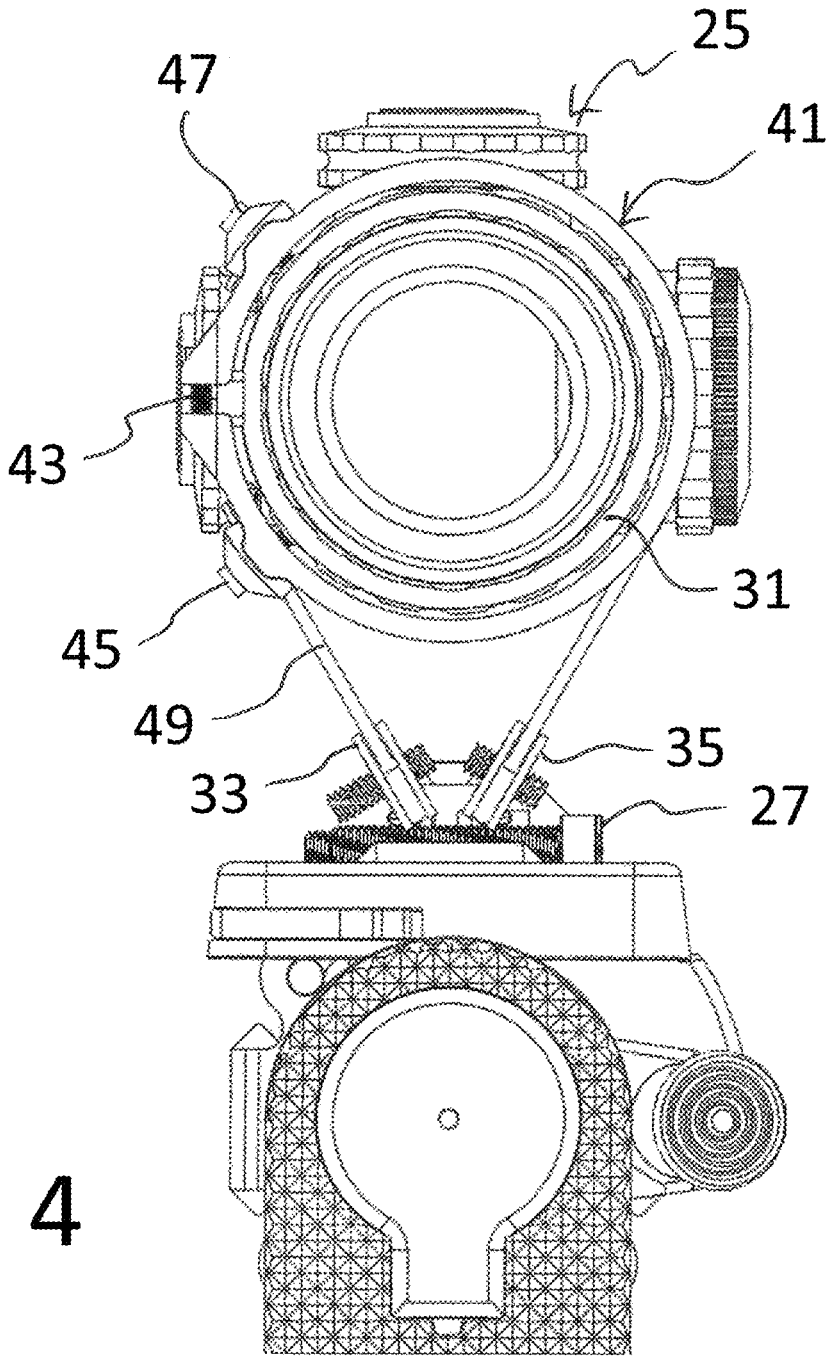
FIG. 4 is a rear detail view of portions of the apparatus of FIG. 1.
Figure 5:
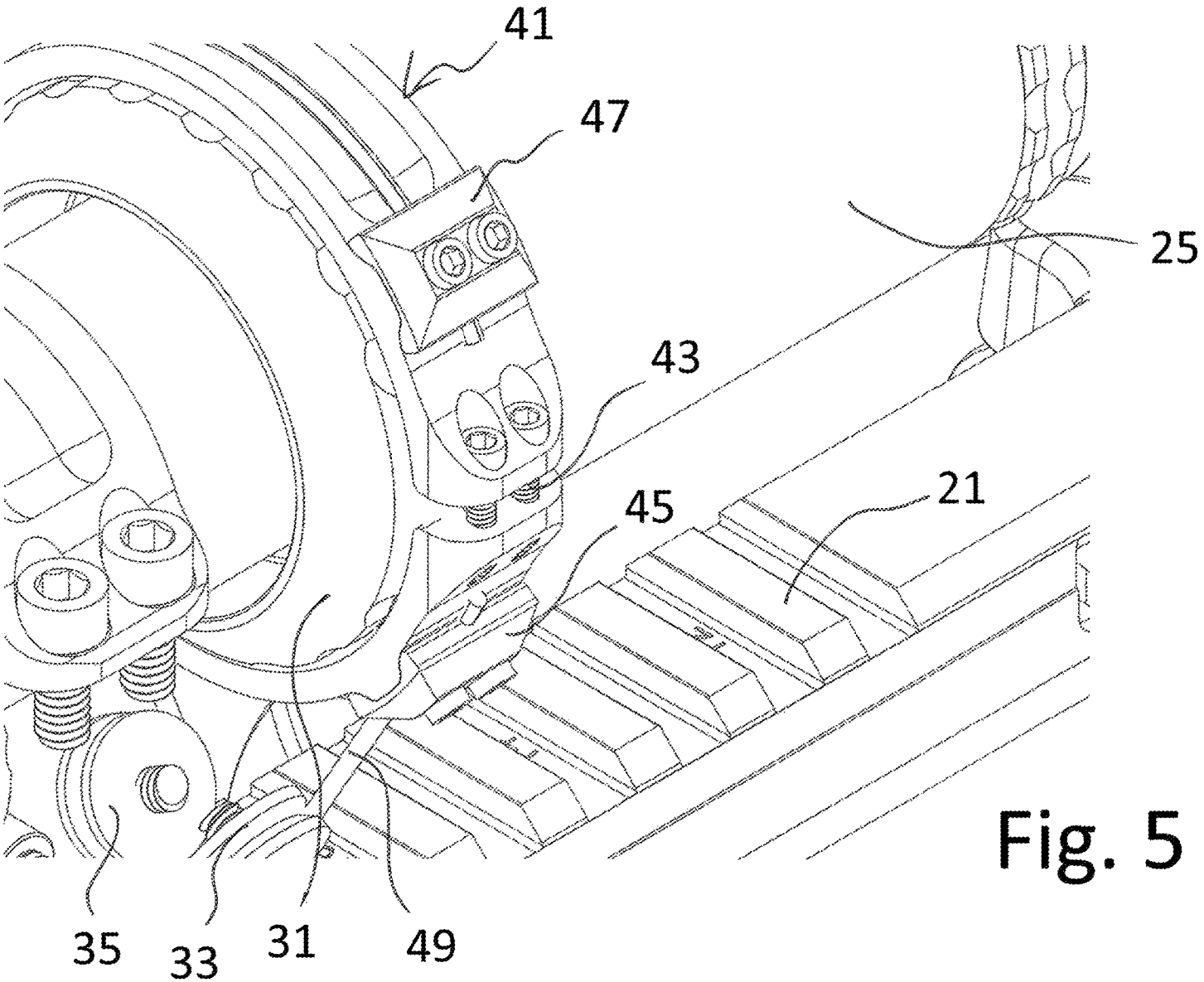
FIG. 5 is an oblique detail view of portions of the apparatus of FIG. 1.

In the specification, reference may be made to the spatial relationships between various components and to the spatial orientation of various aspects of components as the devices are depicted in the attached drawings. However, as will be recognized by those skilled in the art after a complete reading of this disclosure, the devices, members, apparatuses, etc. described herein may be positioned in any desired orientation. Thus, the use of terms such as "above," "below," "upper," "lower," or other like terms to describe a spatial relationship between various components or to describe the spatial orientation of aspects of such components should be understood to describe a relative relationship between the components or a spatial orientation of aspects of such components, respectively, as the device described herein may be oriented in any desired direction.

This disclosure divulges manually operated and electric versions of an apparatus for remotely adjusting scope magnification.

FIGS. 1 through 5 illustrate a firearm 11 incorporating an embodiment of a manually operated adjuster 13 according to this disclosure. Firearm 11 comprises a receiver 15, a buttstock 17, and a forend 19 shrouding a barrel. A rear accessory rail 21 is located on the top of receiver 15, and a forward accessory rail 23 is located on the top of forend 19. An adjustable-magnification scope 25 is mounted on rear rail 21 using a scope mount 27 and scope rings 29. The magnification of scope 25 is adjusted by rotating adjustment ring 31.

In this embodiment, a pulley system provides for manual remote control of rotation of ring 31. Mount 27 comprises a pair of angled rear pulleys 33, 35, and a forward slider assembly 37 comprises front pulley 39. A ring adapter 41 is formed as an incomplete ring that is concentrically installed over ring 31 of scope 25 and then pulled tight using fasteners 43, thus ensuring that rotation of adapter 41 causes corresponding rotation of ring 31. Retainers 45, 47 on adapter 41 are configured for retaining opposite ends of cable 49, which extends from retainer 45 down to rear pulley 33, then forward to front pulley 39, then rearward to rear pulley 35, then upward to retainer 47. When either of retainers 45, 47 are rotated away from pulleys 33, 35, cable 49 wraps over a portion of adapter 41.

Slider assembly 37 comprises a housing 51 mounted to forward rail 23, and front pulley 39 is mounted within a forward portion of housing 51. The top of housing 51 has a longitudinal slot 53 formed therein. A slider 55 is configured to grip a portion of cable 49 within housing 51 and translate longitudinally along slot 53. A grip 57 is coupled to slider 55, and translation of grip 57 by a user causes corresponding motion of cable 49 about pulleys 33, 35, 39. This motion of cable 49 causes rotation of ring 41, allowing for remote adjustment of the magnification of scope 25. In the embodiment shown, grip 57 comprises front and rear vertical wings 59, 61 that allow for a user to push or pull against wings 59, 61 when operating adjuster 13 by translating grip 57. A cover 63 extends between mount 27 and housing 51 for enclosing portions of cable 49.

Though cable 49 is shown as a length of cable having free ends, cable may alternatively be formed as a loop that extends around adapter 41. Also, cable 49 may be formed as an assembly of lengths of cable, and slider 55 may be integrated into the assembly of cable 49.

Figure 6:
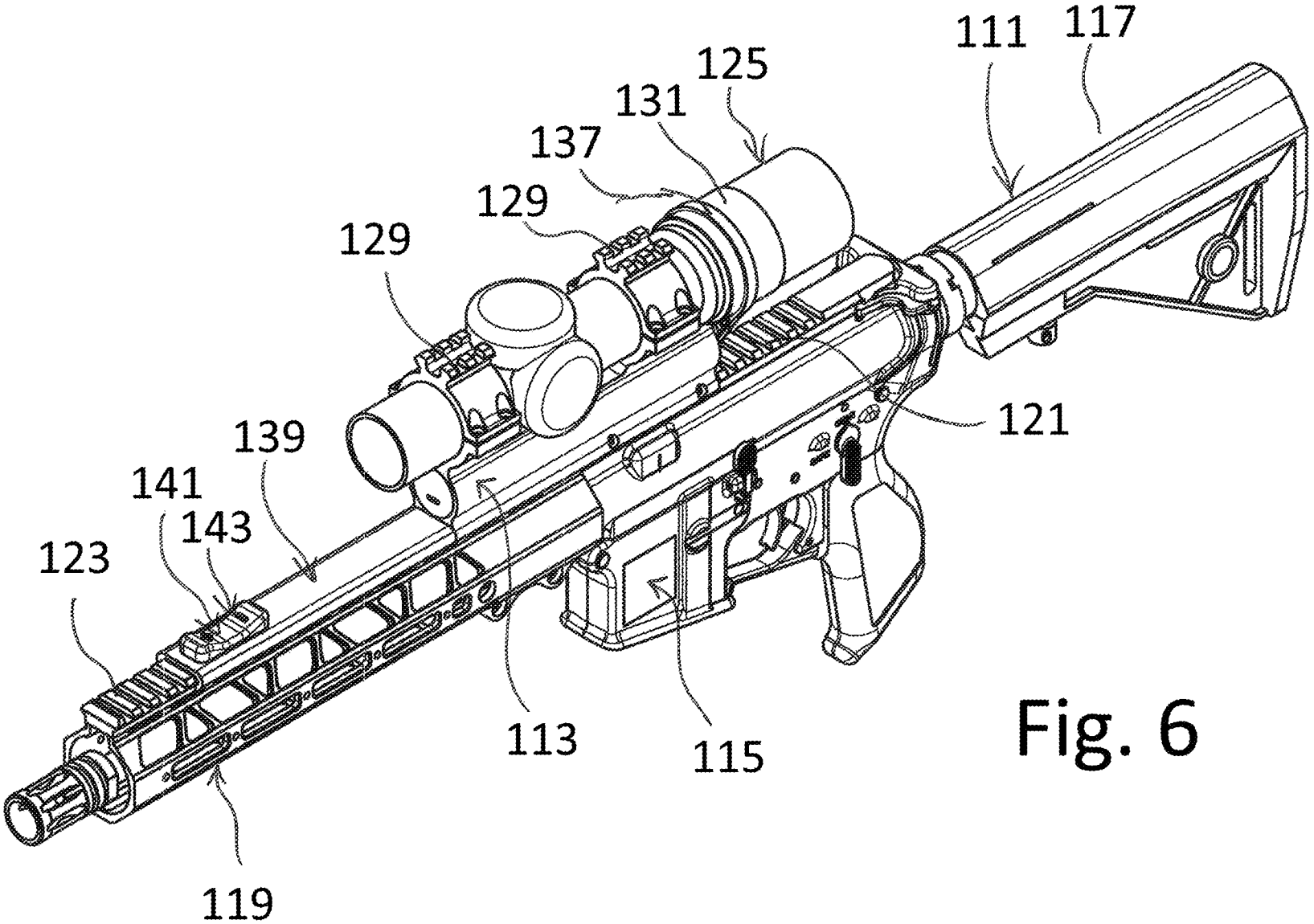
FIG. 6 is an oblique view of a firearm with another embodiment according to this disclosure of an apparatus for remotely adjusting scope magnification.
Figure 7:
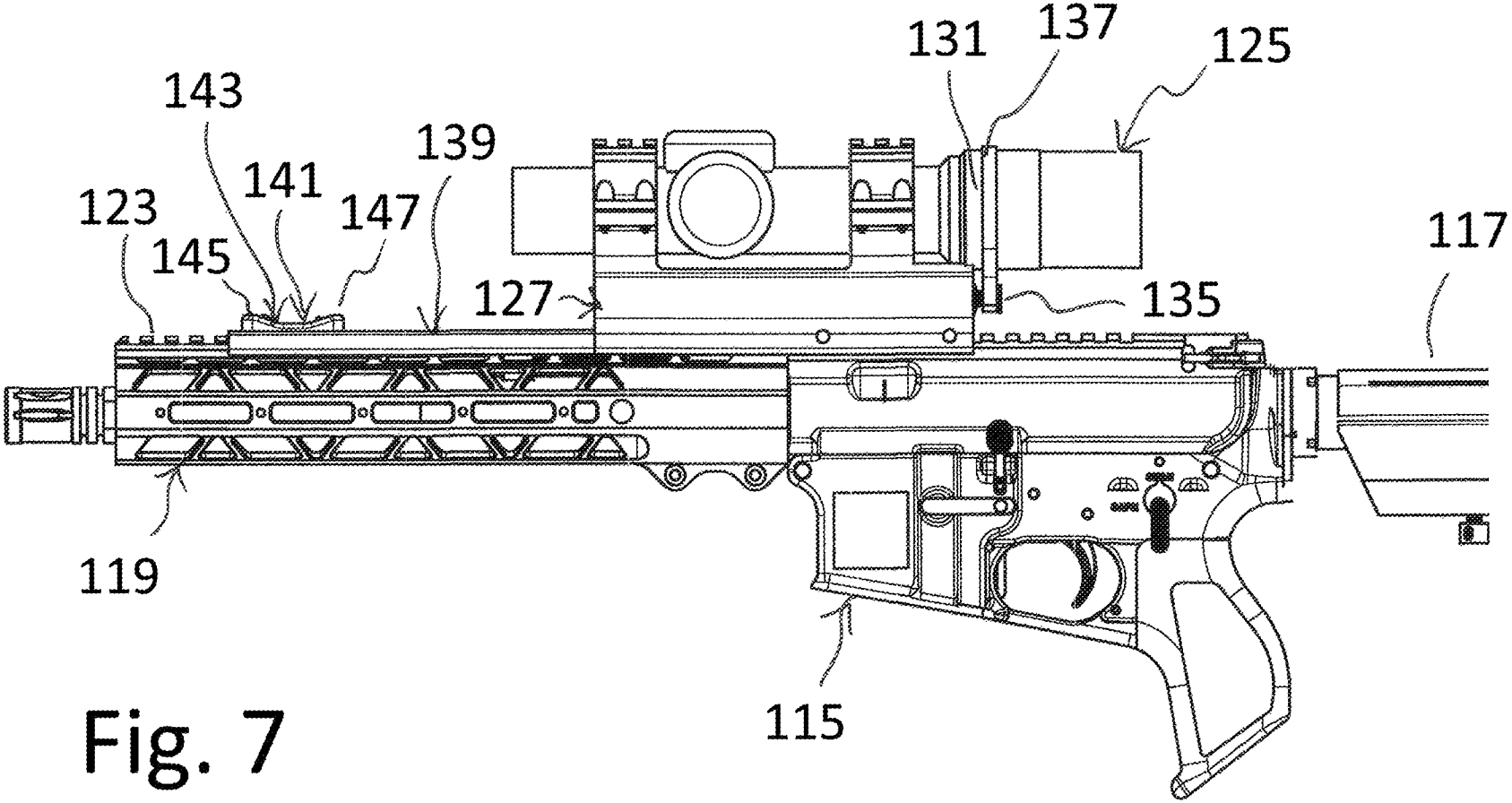
FIG. 7 is a side detail view of portions of the apparatus of FIG. 6.
Figure 8:
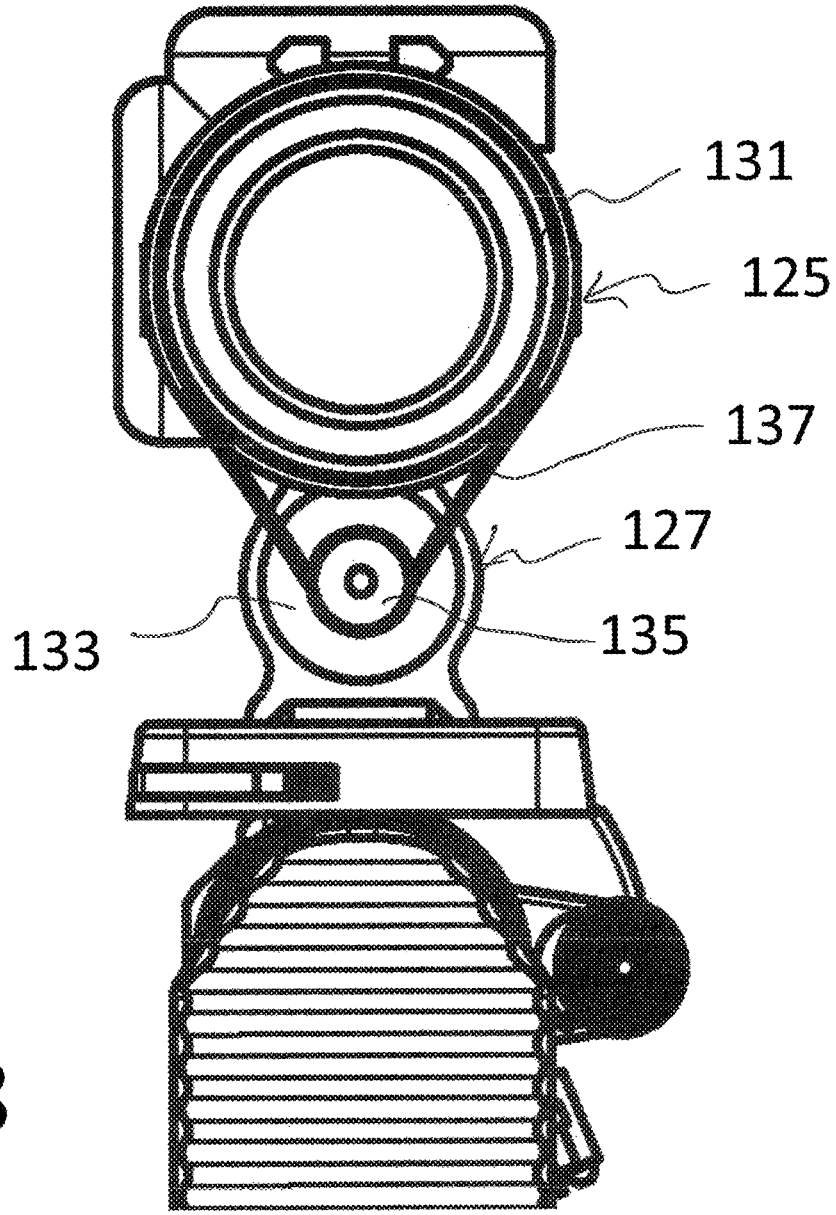
FIG. 8 is a rear detail view of portions of the apparatus of FIG. 6.
Figure 9:
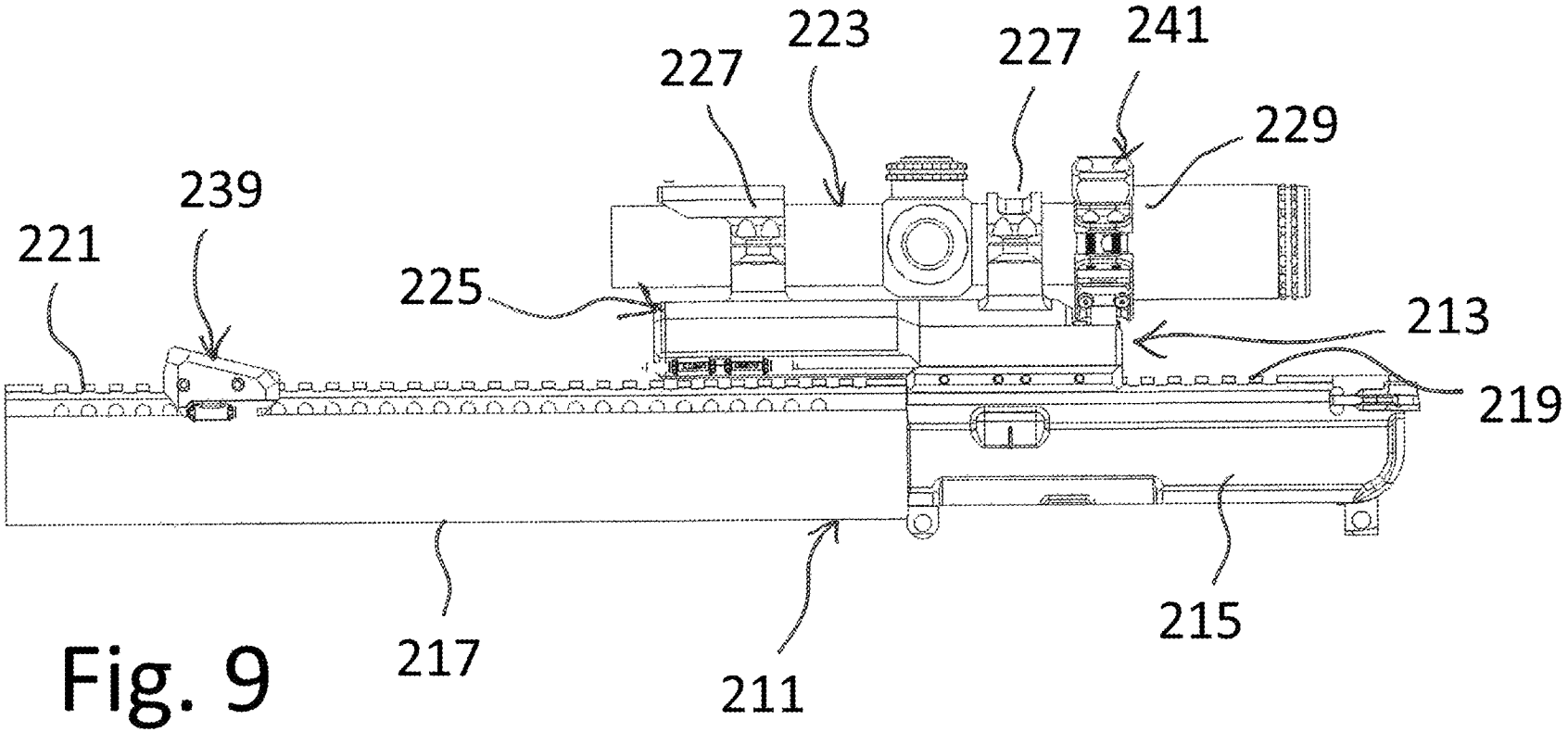
FIG. 9 is a side view of an upper assembly of a firearm with another embodiment of an apparatus according to this disclosure for remotely adjusting scope magnification.
Figure 10:
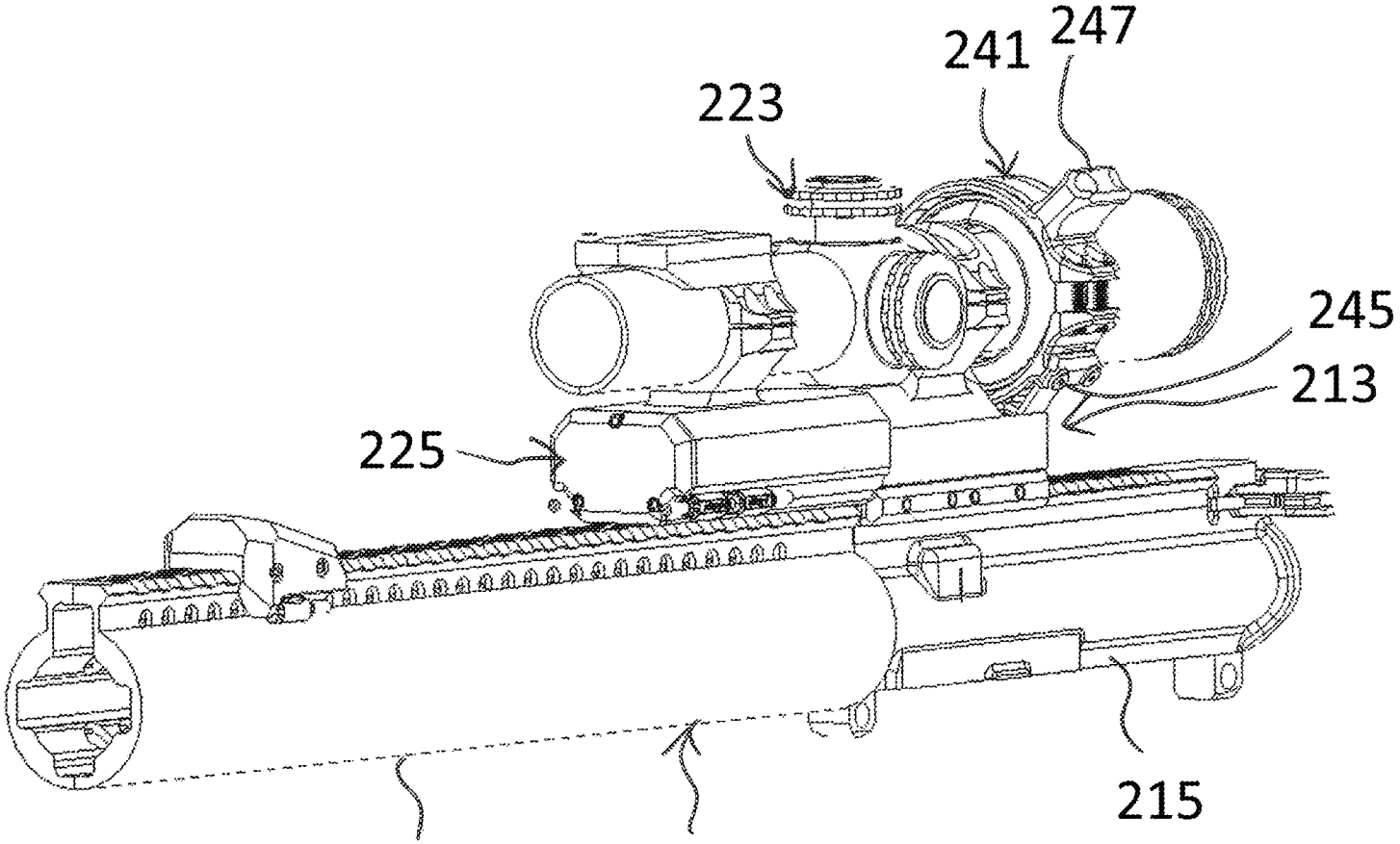
FIG. 10 is an oblique front view of the assembly of FIG. 9.
Figure 11:
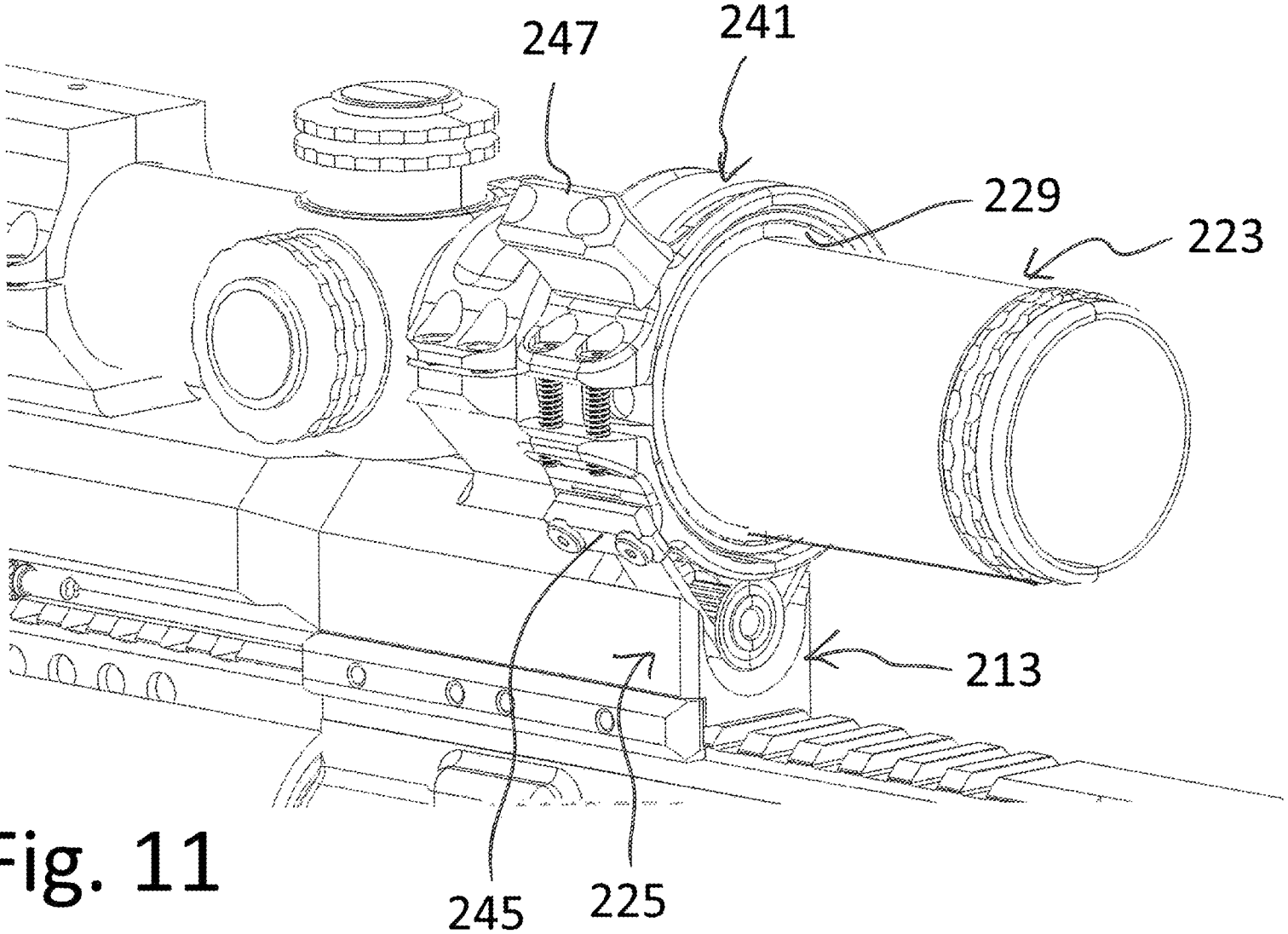
FIG. 11 is an oblique rear view of a portion of the assembly of FIG. 9.
Figure 12:
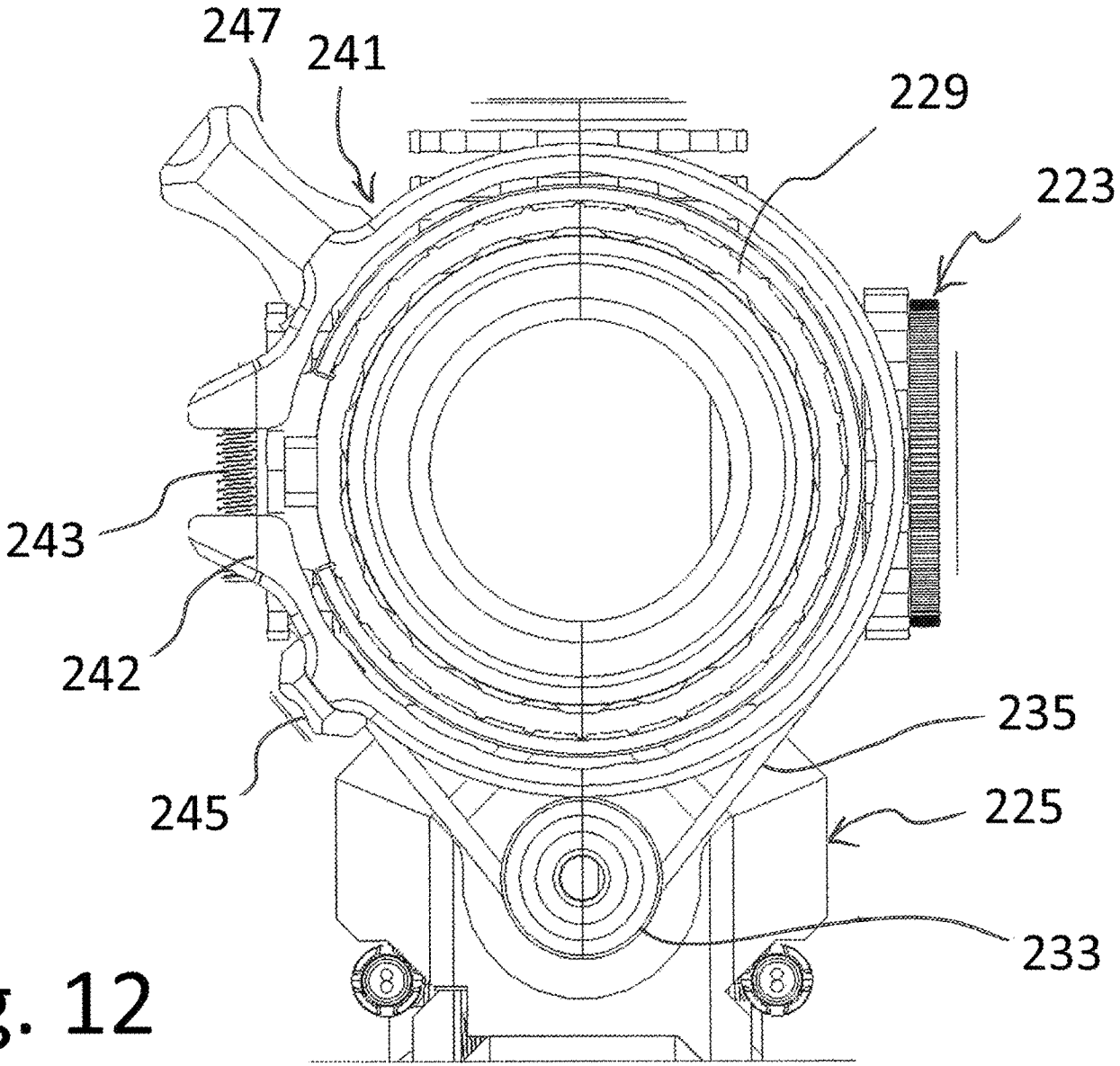
FIG. 12 is a rear view of a portion of the assembly of FIG. 9.
Figure 13:
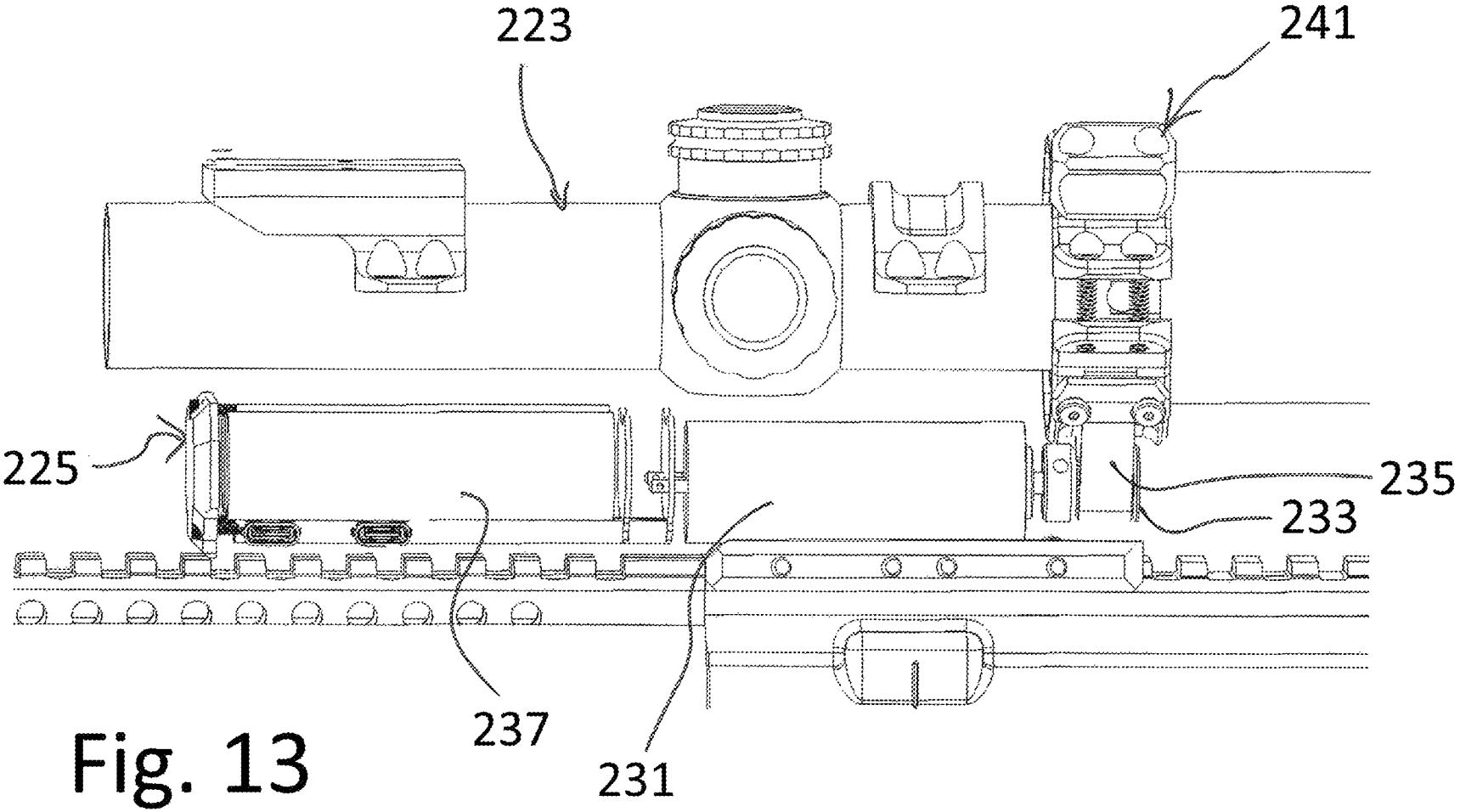
FIG. 13 is a side view of a portion of the assembly of FIG. 9 with components removed for ease of viewing.
Figure 14:
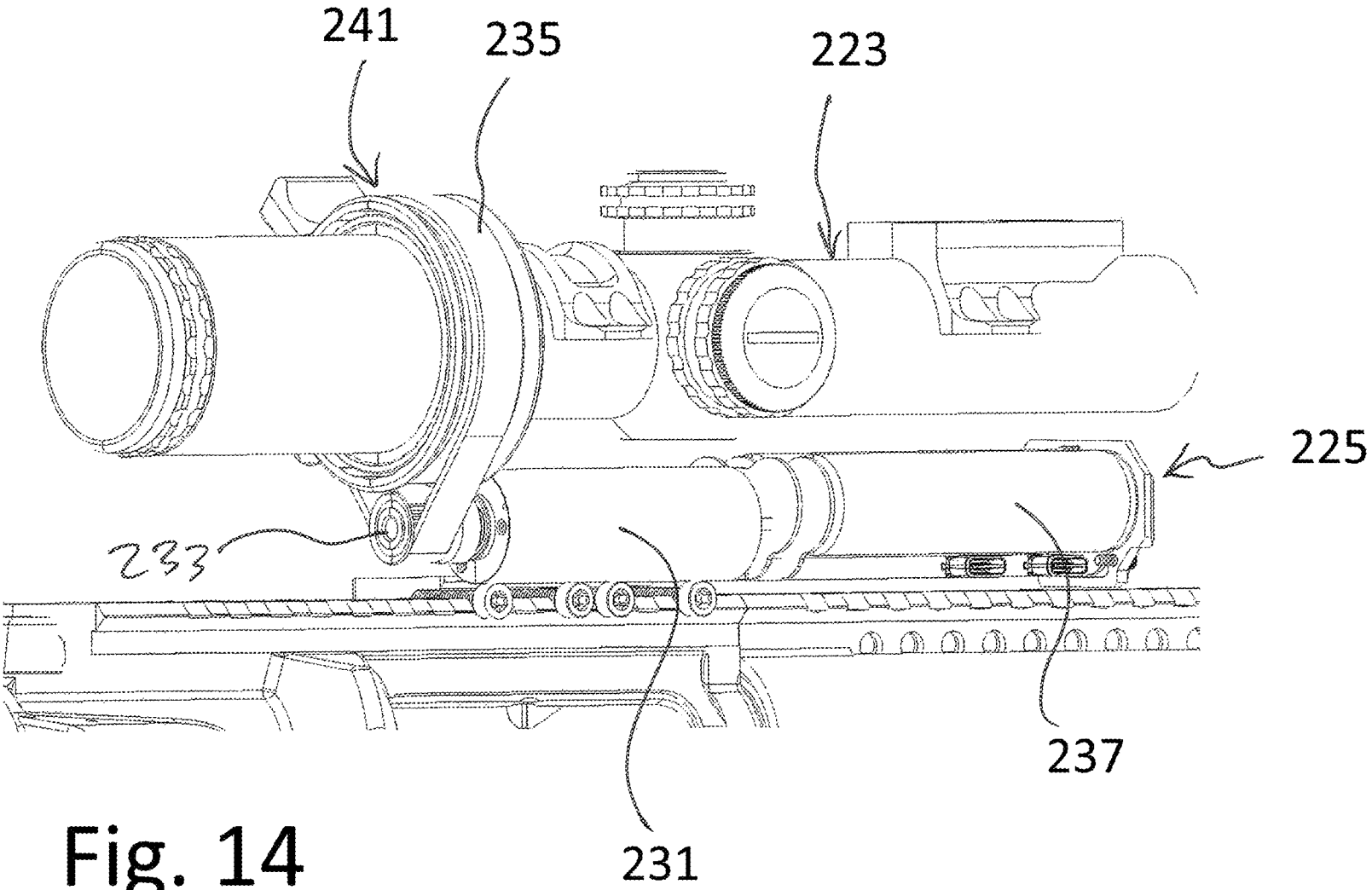
FIG. 14 is an oblique rear view of a portion of the assembly of FIG. 9 with components removed for ease of viewing.
Figure 15:
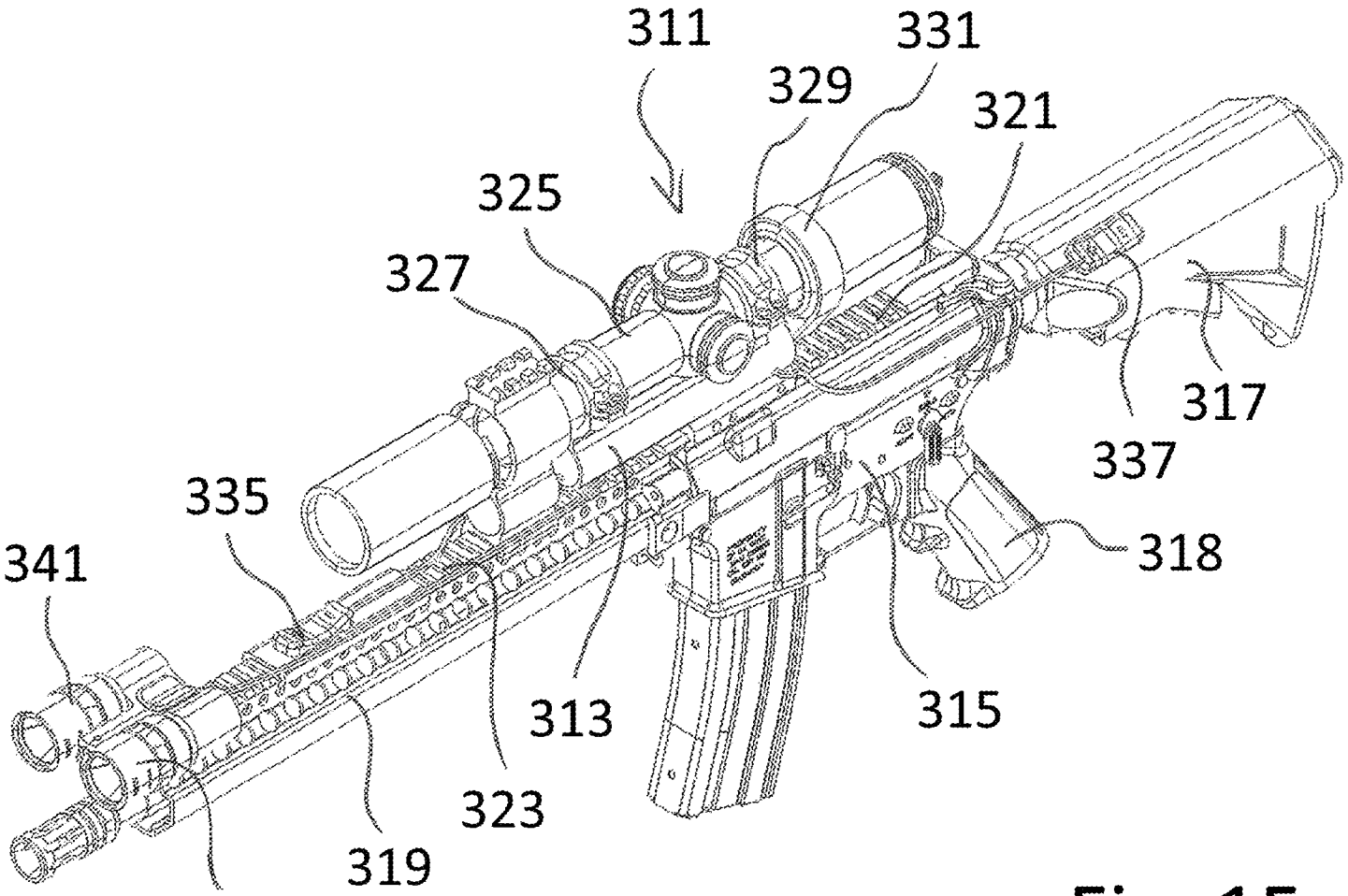
FIG. 15 is a front oblique view of a firearm with an embodiment of a firearm-mounted battery bank according to this disclosure.
Figure 16:
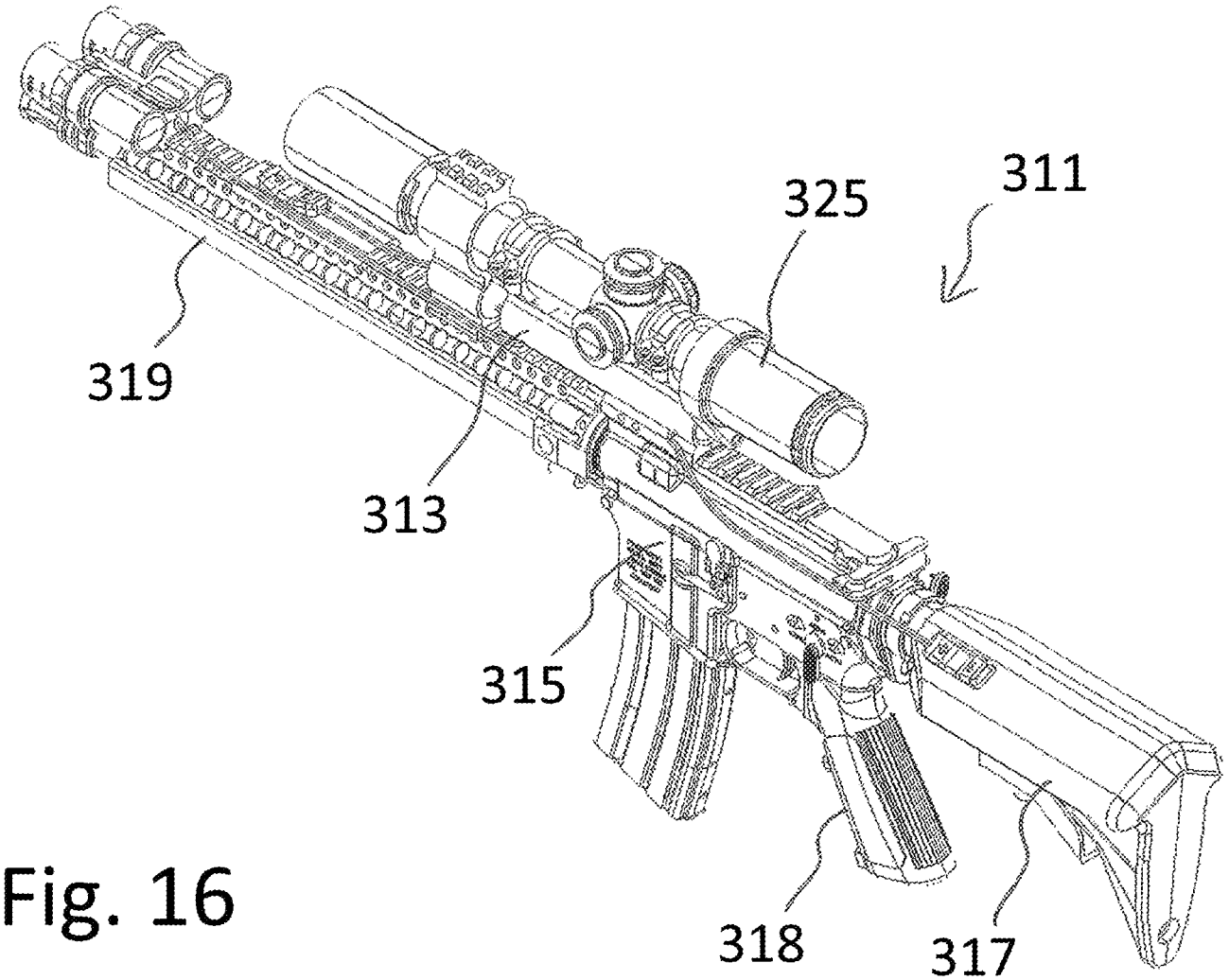
FIG. 16 is a rear oblique view of the firearm of FIG. 15.
Figure 17:
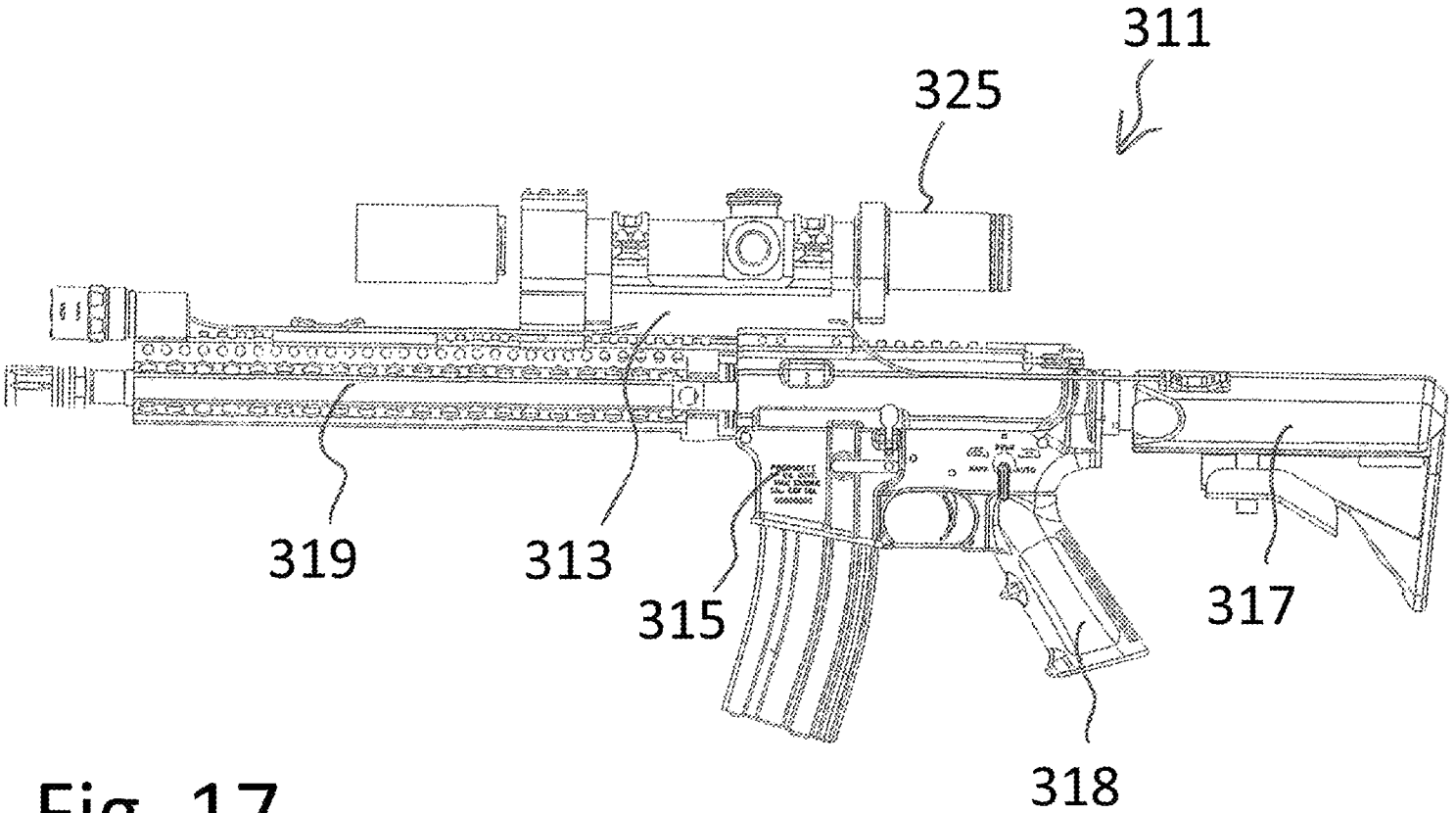
FIG. 17 is a left side view of the firearm of FIG. 15.
Figure 18:
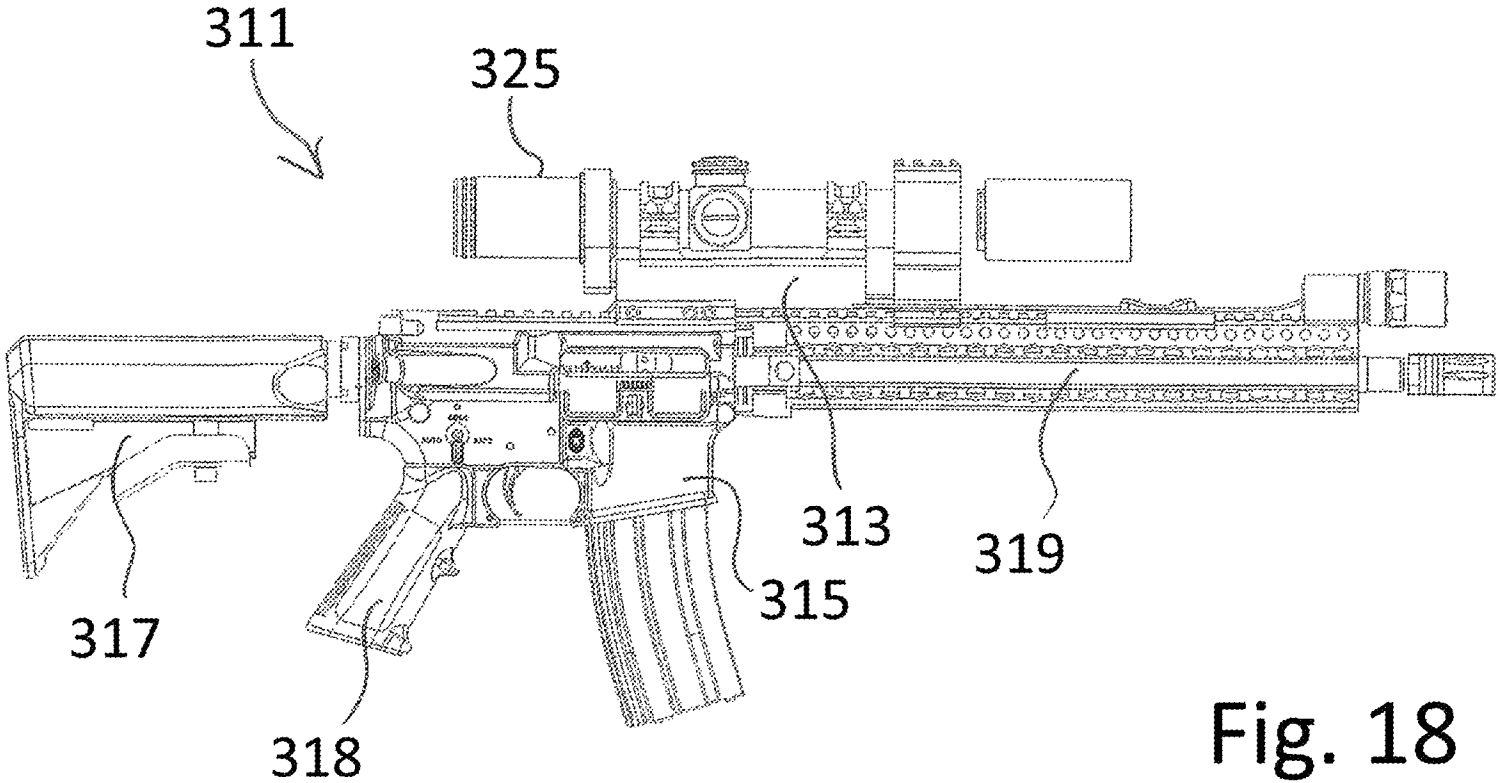
FIG. 18 is a right side view of the firearm of FIG. 15.
Figure 19:
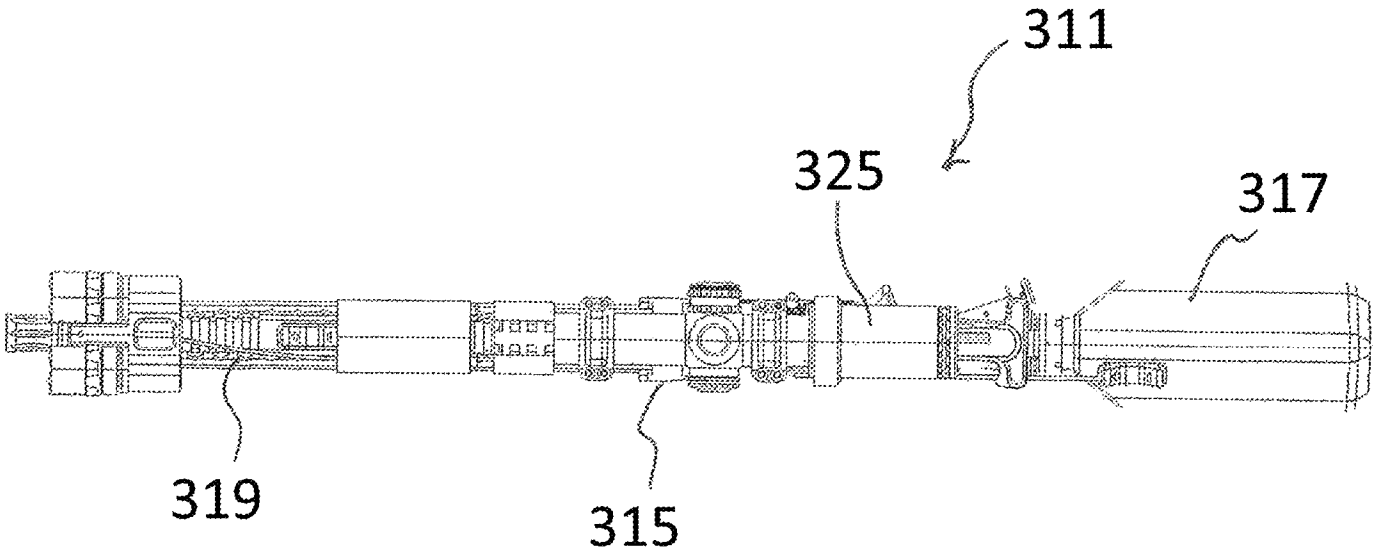
FIG. 19 is a top view of the firearm of FIG. 15.
Figure 20:
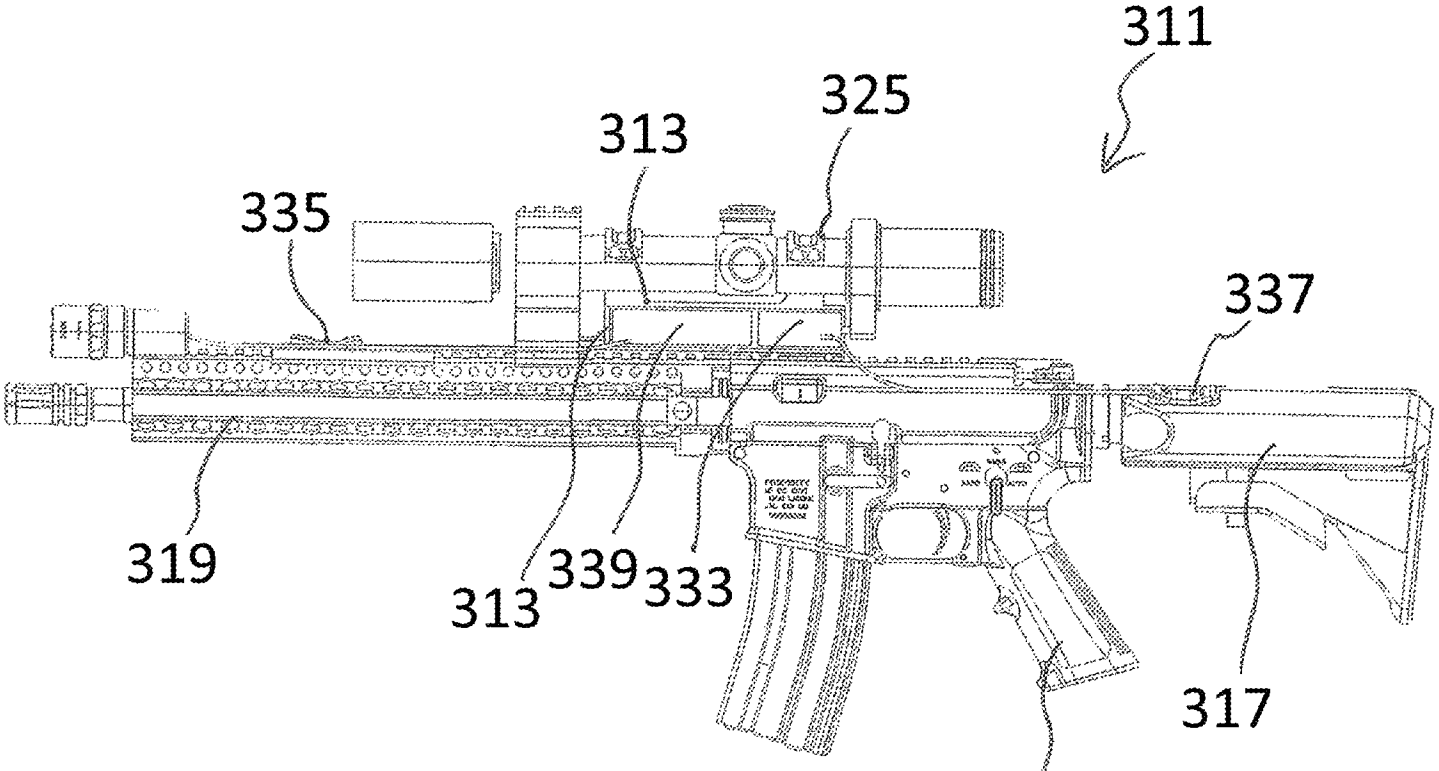
FIG. 20 is a left side view of the firearm of FIG. 15 with a portion of the battery bank removed.

FIGS. 6 through 8 illustrate a firearm 111, which is constructed similarly to firearm 11, and incorporates an embodiment of an electrically operated adjuster 113 according to this disclosure. Firearm 111 comprises a receiver 115, a buttstock 117, and a forend 119 shrouding a barrel. A rear accessory rail 121 is located on the top of receiver 115, and a forward accessory rail 123 is located on the top of forend 119. An adjustable-magnification scope 125 is mounted on rails 121, 123 using a scope mount 127 and scope rings 129. The magnification of scope 125 is adjusted by rotating adjustment ring 131.

In this embodiment, an electric motor system provides for remote control of the rotation of ring 131. Mount 127 comprises an electric motor 133 with a pulley 135, and pulley 135 is coupled to adjustment ring 131 with a belt 137, allowing rotation of motor 133 to cause rotation of ring 131. Though not shown, batteries, circuitry, and/or other components may also be housed within mount 127. A housing 139 mounted to forward rail 123 comprises a switch assembly 141, and a rocker 143 is configured for a user to press a forward portion 145 or a rearward portion 147 to operate motor 133 in a selected direction. Rotation of motor 133 causes rotation of ring 131, allowing for remote adjustment of the magnification of scope 25.

FIGS. 9 through 14 illustrate an upper assembly 211 of a firearm and is similar to the upper assembly of receiver 15 of firearm 11. Assembly 211 incorporates another embodiment of an electrically operated adjuster 213 according to this disclosure. Assembly 211 comprises an upper receiver 215 and a forend 217 for shrouding a barrel. A rear accessory rail 219 is located on the top of upper receiver 215, and a forward accessory rail 221 is located on the top of forend 217. An adjustable-magnification scope 223 is mounted on rails 219, 221 using a scope mount 225 and scope rings 227. The magnification of scope 223 is adjusted by rotating adjustment ring 229.

Like adjuster 113, in this embodiment an electric motor system provides for remote control of the rotation of ring 229. Mount 225 comprises an electric motor 231 with a pulley 233, and pulley 233 is coupled to adjustment ring 229 with a belt 235, allowing rotation of motor 225 to cause rotation of ring 229. Motor 231 is powered by battery 237 housed within mount 225. A housing 239 mounted to forward rail 221 comprises a switch assembly for a user to operate motor 231 in a selected direction.

A ring adapter 241 is constructed similarly to ring adapter 41 and comprises an incomplete ring 242 that is concentrically installed over ring 229 of scope 223 and then pulled tight using fasteners 243, thus ensuring that rotation of adapter 241 causes corresponding rotation of ring 229. A pair of retainers 245, 247 on adapter 241 are configured for retaining opposite ends of belt 235, which extends around pulley 233 between retainers 245, 247. As shown, retainer 247 extends away from ring 242 to act a as a lever for manual operation of adjuster 213. When either of retainers 245, 247 are rotated away from pulley 233, belt 235 wraps over a portion of adapter 241. Thus, rotation of motor 231 causes rotation of ring adapter 241 and adjustment ring 229, allowing for remote adjustment of the magnification of scope 223.

This disclosure also divulges a battery bank mounted to a firearm and configured to power accessories carried thereon. The need for a battery bank on firearms is becoming more and more needed due to the fact that lights, lasers, night vision and thermal devices all require electrical power. Providing a separate battery for each device increases weight and may unbalance the firearm, such as when several devices are positioned in a forward location.

FIGS. 15 through 20 illustrate a firearm 311 incorporating an embodiment of a battery housing 313 according to this disclosure. Firearm 311 comprises a receiver 315, a buttstock 317, a pistol grip 318, and a forend 319 shrouding a barrel. A rear accessory rail 321 is located on the top of receiver 315, and a forward accessory rail 323 is located on the top of forend 319. An adjustable-magnification scope 325 is mounted on rear rail 321 using scope rings 327, 329. The magnification of scope 325 is adjusted by using adjustment mechanism 331. In the embodiment shown, a lower portion of each ring 327, 329 is integral with housing 313, though rings 327, 329 and housing 313 may be separate components each coupled to rail 321.

In this embodiment, an electric motor system provides for control of the adjustment mechanism 331. Housing 313 comprises an electric motor 333 that engages mechanism 331 for adjusting the magnification of scope 325, and switches 335, 337 are capable of selective operation of motor 333, allowing for remote adjustment of the magnification of scope 325. Switch 337 is shown mounted on rail 323, and switch 337 is shown mounted on a cheek rest of buttstock 317, though one or both of switches 335, 337 may be located in alternative locations, such as on grip 318, or additional witches may be added to the system. Adjustment mechanism 331 may comprise a belt or similar component for coupling motor 333 to an adjuster ring of scope 325. It is preferred that neither motor 333 nor mechanism 331 comprise a gear-reduction component, thereby ensuring the system produces less ambient noise than systems having a gear-reduction component.

FIG. 6 illustrates housing 313 with a portion removed, allowing the interior of housing 313 to be visible. In addition to motor 333, housing 313 carries a battery bank 339 capable of providing electrical power to motor 333 and to other accessories carried by firearm 311. For example, power may be supplied to flashlights 341, 343 mounted at a forward end of forend 319. A non-exhaustive list of example additional accessories (not shown) includes:

red dot sight
holographic optic
prism optic
illuminated scope
electric zoom
visible laser
infrared laser/illuminator
night vision
thermal device
radio and/or radio controls
rangefinder
heads-up display
touchscreen ATAC (phone, OLED watch face)

Battery bank 339 may alternatively be located in another position on firearm 311. For example, bank 339 may be located in grip 318 or in buttstock 317, or battery banks may be located in these or other locations in addition to bank 339 located in housing 313. Locating a battery bank in buttstock 317 locates weight toward the rear of firearm 311, which may mitigate the effects of weight from accessories located toward the front firearm 311.

Battery bank 339 and other battery banks carried on firearm 311 may comprise custom rechargeable battery cells or may comprise rechargeable or standardized single-use (replaceable) batteries. Bank 339 may include recharging ports for supplying power to bank 339 and power ports for drawing power from bank 339, and the system include or be capable of connecting to a solar power component for charging bank 339.

It should be noted that battery 339 may be located in a housing that is configured to be used with existing scope mounts. Also, a switch on grip 318 may have additional features that allow for control of several functions on one interface, such as scope zoom, operation of lights or lasers, push-to-talk radio functions, etc. Another embodiment has a battery bank built into a rifle chassis that accepts firearm components, with the battery bank located in a forend, in the buttstock, or both.

At least one embodiment is disclosed, and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 95 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention. Also, the phrases "at least one of A, B, and C" and "A and/or B and/or C" should each be interpreted to include only A, only B, only C, or any combination of A, B, and C.

What is claimed is:

1. An assembly allowing for remote control of magnification of a scope of a firearm, the assembly comprising:

a mount adapted for an adjustable-magnification scope to be mounted thereto;

a motor carried by the mount;

a battery configured for providing electrical power to the motor;

a ring adapter adapted to be coupled to an adjuster ring of the scope for rotation therewith, the ring adapter having a pair of retainers;

a belt having opposite end portions and coupling the motor to the ring adapter, each retainer configured for attaching one of the end portions to the ring; and a switch adapted to be actuated by a user for controlling operation of the motor for causing selective rotation of the adjuster ring to adjust a magnification of the scope.

2. The assembly of claim 1, further comprising:

scope rings integral to the mount and adapted for carrying the scope.

3. The assembly of claim 1, wherein the battery is rechargeable.

4. The assembly of claim 1, wherein the battery comprises a port for charging the battery.

5. The assembly of claim 1, wherein the ring adapter is an incomplete ring adapted to be concentrically installed onto the adjuster ring.

6. The assembly of claim 5, wherein at least one fastener is configured to tighten the ring adapter onto the adjuster ring.

7. The assembly of claim 1, wherein at least one retainer extends outward from the ring adapter for forming a lever adapted to allow for manual adjustment of the scope.

* * * * *